US009741298B2

(12) United States Patent
Baek et al.

(10) Patent No.: US 9,741,298 B2
(45) Date of Patent: Aug. 22, 2017

(54) DISPLAY APPARATUS AND METHOD OF DRIVING THE SAME

(71) Applicant: Samsung Display Co., LTD., Yongin, Gyeonggi-Do (KR)

(72) Inventors: Kwang-Hyun Baek, Asan-si (KR); Hyun-Seop Song, Bucheon-si (KR); Hyong-Do Choi, Yongin-si (KR); Joo-Suk Lee, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 3 days.

(21) Appl. No.: 14/734,291

(22) Filed: Jun. 9, 2015

(65) Prior Publication Data

US 2016/0171943 A1 Jun. 16, 2016

(30) Foreign Application Priority Data

Dec. 16, 2014 (KR) ..... 10-2014-0181764

(51) Int. Cl.
*G09G 3/36* (2006.01)

(52) U.S. Cl.
CPC ..... *G09G 3/3614* (2013.01); *G09G 3/3655* (2013.01); *G09G 2320/0247* (2013.01)

(58) Field of Classification Search
CPC . G06F 3/038; G09G 5/00; G09G 3/10; G09G 3/20; G09G 3/36
See application file for complete search history.

(56) References Cited

U.S. PATENT DOCUMENTS

2001/0004253 A1* 6/2001 Fukutoku ..... G09G 3/3614 345/96
2008/0001890 A1* 1/2008 Song ..... G09G 3/3614 345/96
2008/0170025 A1* 7/2008 Song ..... G09G 3/3614 345/96
2012/0162183 A1* 6/2012 Kwon ..... G09G 3/3614 345/212
2013/0222216 A1* 8/2013 Park ..... G09G 3/3614 345/55
2014/0092077 A1* 4/2014 Kim ..... G09G 3/3611 345/212
2015/0145844 A1* 5/2015 Kwak ..... G09G 3/3614 345/209

FOREIGN PATENT DOCUMENTS

KR 1020020039898 A 5/2002
KR 1020040016185 A 2/2004
KR 1020040085495 A 10/2004
KR 1020070062134 A 6/2007
KR 1020100048199 A 5/2010

* cited by examiner

*Primary Examiner* — Pegeman Karimi
(74) *Attorney, Agent, or Firm* — Cantor Colburn LLP

(57) ABSTRACT

A display apparatus includes a display panel which displays an image, a timing controller which determines an inversion driving method of the display panel based on a waveform of a fed back common voltage from the display panel, and a data driver which outputs a data voltage to the display panel according to the inversion driving method.

17 Claims, 9 Drawing Sheets

100

| | R | G | B | R | G | B | R | G | B | R | G | B |
|---|---|---|---|---|---|---|---|---|---|---|---|---|
| | − | + | − | + | − | + | − | + | − | + | − | + |
| | − | + | − | + | − | + | − | + | − | + | − | + |
| PRN | + | − | + | − | + | − | + | − | + | − | + | − |
| PRN+1 | + | − | + | − | + | − | + | − | + | − | + | − |
| PRN+2 | − | + | − | + | − | + | − | + | − | + | − | + |
| PRN+3 | − | + | − | + | − | + | − | + | − | + | − | + |
| PRN+4 | + | − | + | − | + | − | + | − | + | − | + | − |
| PRN+5 | + | − | + | − | + | − | + | − | + | − | + | − |
| | − | + | − | + | − | + | − | + | − | + | − | + |
| | − | + | − | + | − | + | − | + | − | + | − | + |
| | + | − | + | − | + | − | + | − | + | − | + | − |
| | + | − | + | − | + | − | + | − | + | − | + | − |

DISPLAY APPARATUS AND METHOD OF DRIVING THE SAME

This application claims priority to Korean Patent Application No. 10-2014-0181764, filed on Dec. 16, 2014, and all the benefits accruing therefrom under 35 U.S.C. §119, the content of which in its entirety is herein incorporated by reference.

BACKGROUND

1. Field

Exemplary embodiments of the invention relate to a display apparatus and a method of driving the display apparatus. More particularly, exemplary embodiments of the invention relate to a display apparatus with improved display quality and a method of driving the display apparatus.

2. Description of the Related Art

A display apparatus typically includes a first substrate including a pixel electrode and a second substrate including a common electrode. In such a display apparatus, an electric field may be generated by voltages applied to the pixel electrode and the common electrode, and a desired image may be displayed by adjusting an intensity of the electric field.

In a display apparatus, a grayscale of a pixel is typically determined by a difference between a pixel voltage applied to the pixel electrode and a common voltage applied to the common electrode. When the pixel electrode has a single polarity with respect to the common voltage, a residual direct-current ("DC") voltage may be accumulated at the common electrode. Due to the accumulated residual DC voltage, a display quality of a display panel of the display apparatus may be deteriorated.

To prevent such residual DC from being accumulated, a positive pixel voltage having a positive polarity with respect to the common voltage and a negative pixel voltage having a negative polarity with respect to the common voltage may be alternately applied to the pixels of the display panel in every frame. An above explained driving method is typically referred to as a frame inversion method. When positive pixel voltages are applied to all of the pixels during a first frame and negative pixel voltages are applied to all of the pixels during a second frame, a flickering may occur due to a difference of luminance between the positive pixel voltage and the negative pixel voltage which correspond to the same grayscale.

Thus, the positive pixel voltage and the negative pixel voltage may be alternately applied to the pixels of the display panel to have a specific polarity pattern in the same frame. For example, positive pixel voltages may be applied to pixels in a first pixel column and negative pixels may be applied to pixels in a second pixel column. An above explained driving method is typically referred to as a column inversion method. Alternatively, the positive pixel voltage and the negative pixel voltage may be alternately applied to the pixels in a column direction and a row direction. An above explained driving method is typically referred to as a dot inversion method.

SUMMARY

When a display panel of a display apparatus displays specific display patterns, a polarity orientation, which the polarities of the pixels are oriented in one polarity, may be generated according to the inversion methods. Due to the polarity orientation, a ripple of the common voltage may be generated so that a level of the common voltage may be distorted.

When the ripple of the common voltage is generated or the common voltage is distorted, some pixels may not display a desired luminance. Accordingly, the luminance difference between pixels may be generated. Due to the luminance difference, the display defect may be generated.

Exemplary embodiments of the invention provide a display apparatus including a display panel with improved display quality.

Exemplary embodiments of the invention further provide a method of driving the display apparatus.

In an exemplary embodiment according to the invention, a display apparatus includes a display panel which displays an image, a timing controller which determines an inversion driving method of the display panel based on a waveform of a fed back common voltage from the display panel and a data driver which outputs a data voltage to the display panel according to the inversion driving method.

In an exemplary embodiment, the display apparatus may further include a common voltage converting part which receives a fed back common voltage from the display panel and converts the fed back common voltage into a square wave signal to output a converted common voltage to the timing controller.

In an exemplary embodiment, the common voltage converting part may include a first amplifier which receives a positive ripple component of the fed back common voltage and generates a positive square wave based on the positive ripple component of the fed back common voltage and a second amplifier which receives a negative ripple component of the fed back common voltage and generates a negative square wave based on the negative ripple component of the fed back common voltage.

In an exemplary embodiment, the common voltage converting part may further include a capacitor including a first end to which the fed back common voltage is applied and a second end connected to a first input terminal of the first amplifier and a second input terminal of the second amplifier, a first damping resistor including a first end to which a positive power voltage is applied and a second end connected to a first node, a second damping resistor including a first end to which a negative power voltage is applied and a second end connected to a second node and a short preventing resistor connected between the first node and the second node.

In an exemplary embodiment, the common voltage converting part may further include a first amplifying resistor including a first end connected to the first node and a second end connected to a second input terminal of the first amplifier, a second amplifying resistor including a first end connected to the second input terminal of the first amplifier and a second end connected to an output terminal of the first amplifier, a third amplifying resistor including a first end connected to the second node and a second end connected to a first input terminal of the second amplifier and a fourth amplifying resistor including a first end connected to the first input terminal of the second amplifier and a second end connected to an output terminal of the second amplifier.

In an exemplary embodiment, the timing controller may include an inversion controlling part which determines the inversion driving method based on the converted common voltage which is the square wave signal, a signal generating part which outputs a data control signal to the data driver for controlling the data driver based on the inversion driving method and an image compensating part which rearranges a data signal based on the inversion driving method and outputs the rearranged data signal to the data driver.

In an exemplary embodiment, the inversion controlling part may be which count the number of square waves equal to or greater than a distortion threshold among square waves of the converted common voltage. The inversion controlling part may be which changes the inversion driving method of the display panel in a present frame when the number of the square waves equal to or greater than the distortion threshold in a previous frame is equal to or greater than an inversion changing threshold.

In an exemplary embodiment, the display panel may include: a plurality of subpixels substantially in a matrix form; and a plurality of data lines connected to the subpixels, and the display panel may have a non-alternating pixel structure, in which the subpixels in a first subpixel column may be connected to a first data line of the data lines, and the subpixels in a second subpixel column may be connected to a second data line of the data lines.

In an exemplary embodiment, the display panel may be driven in one of a first inversion driving method and a second inversion driving method based on the waveform of the fed back common voltage. In such an embodiment, when the display panel is driven in the first inversion driving method, polarities of the subpixels may be inverted in every dot along a row direction and polarities of the subpixels may be inverted in every two dots along a column direction. In such an embodiment, when the display panel is driven in the second inversion driving method, polarities of the subpixels may be inverted in every two dots along the row direction and polarities of the subpixels may be inverted in every dot along the column direction.

In an exemplary embodiment, the display panel may include: a plurality of subpixels substantially in a matrix form; and a plurality of data lines connected to the subpixels, and the display panel may have an alternating pixel structure, in which the subpixels in a first subpixel column may be alternately connected to a first data line and a second data line of the data lines, the subpixels in a second subpixel column may be alternately connected to the second data line and a third data line of the data lines, and the subpixels in a third subpixel column may be alternately connected to the third data line and a fourth data line of the data lines.

In an exemplary embodiment, the display panel may be driven in one of a first inversion driving method and a second inversion driving method based on the waveform of the fed back common voltage. In such an embodiment, when the display panel is driven in the first inversion driving method, data voltages having a first polarity may be applied to the first data line and the third data line and data voltages having a second polarity opposite to the first polarity may be applied to the second data line and the fourth data line. In such an embodiment, when the display panel is driven in the second inversion driving method, data voltages having the first polarity may be applied to the first data line and the second data line and data voltages having the second polarity may be applied to the third data line and the fourth data line.

In an exemplary embodiment of a method of driving a display apparatus according to the invention, the method includes determining an inversion driving method of a display panel of the display apparatus based on a waveform of a fed back common voltage from the display panel and outputting a data voltage to the display panel according to the inversion driving method.

In an exemplary embodiment, the method may further include receiving the fed back common voltage from the display panel and converting the fed back common voltage into a square wave signal to generate a converted common voltage.

In an exemplary embodiment, the converting the fed back common voltage into the square wave signal may include using a common voltage converting part, and a common voltage converting part may include: a first amplifier which receives a positive ripple component of the fed back common voltage and generates a positive square wave based on the positive ripple component of the fed back common voltage; and a second amplifier which receives a negative ripple component of the fed back common voltage and generates a negative square wave based on the negative ripple component of the fed back common voltage.

In an exemplary embodiment, the common voltage converting part may further include a capacitor including a first end to which the fed back common voltage is applied and a second end connected to a first input terminal of the first amplifier and a second input terminal of the second amplifier, a first damping resistor including a first end to which a positive power voltage is applied and a second end connected to a first node, a second damping resistor including a first end to which a negative power voltage is applied and a second end connected to a second node and a short preventing resistor connected between the first node and the second node.

In an exemplary embodiment, the common voltage converting part may further include a first amplifying resistor including a first end connected to the first node and a second end connected to a second input terminal of the first amplifier, a second amplifying resistor including a first end connected to the second input terminal of the first amplifier and a second end connected to an output terminal of the first amplifier, a third amplifying resistor including a first end connected to the second node and a second end connected to a first input terminal of the second amplifier and a fourth amplifying resistor including a first end connected to the first input terminal of the second amplifier and a second end connected to an output terminal of the second amplifier.

In an exemplary embodiment, the determining the inversion driving method of the display panel may include counting the number of square waves equal to or greater than a distortion threshold among square waves of the converted common voltage, and changing the inversion driving method of the display panel in a present frame when the number of the square waves equal to or greater than the distortion threshold in a previous frame is equal to or greater than an inversion changing threshold.

According to exemplary embodiments of the display apparatus and the method of driving the display apparatus, as described herein, the inversion driving method of the display panel is determined based on the waveform of the fed back common voltage from the display panel. In such embodiment, when the ripple of the common voltage is generated or the common voltage is distorted, the inversion method of the display panel is changed so that the display defect due to the distortion of the common voltage may be prevented. Thus, the display quality of the display panel may be improved.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
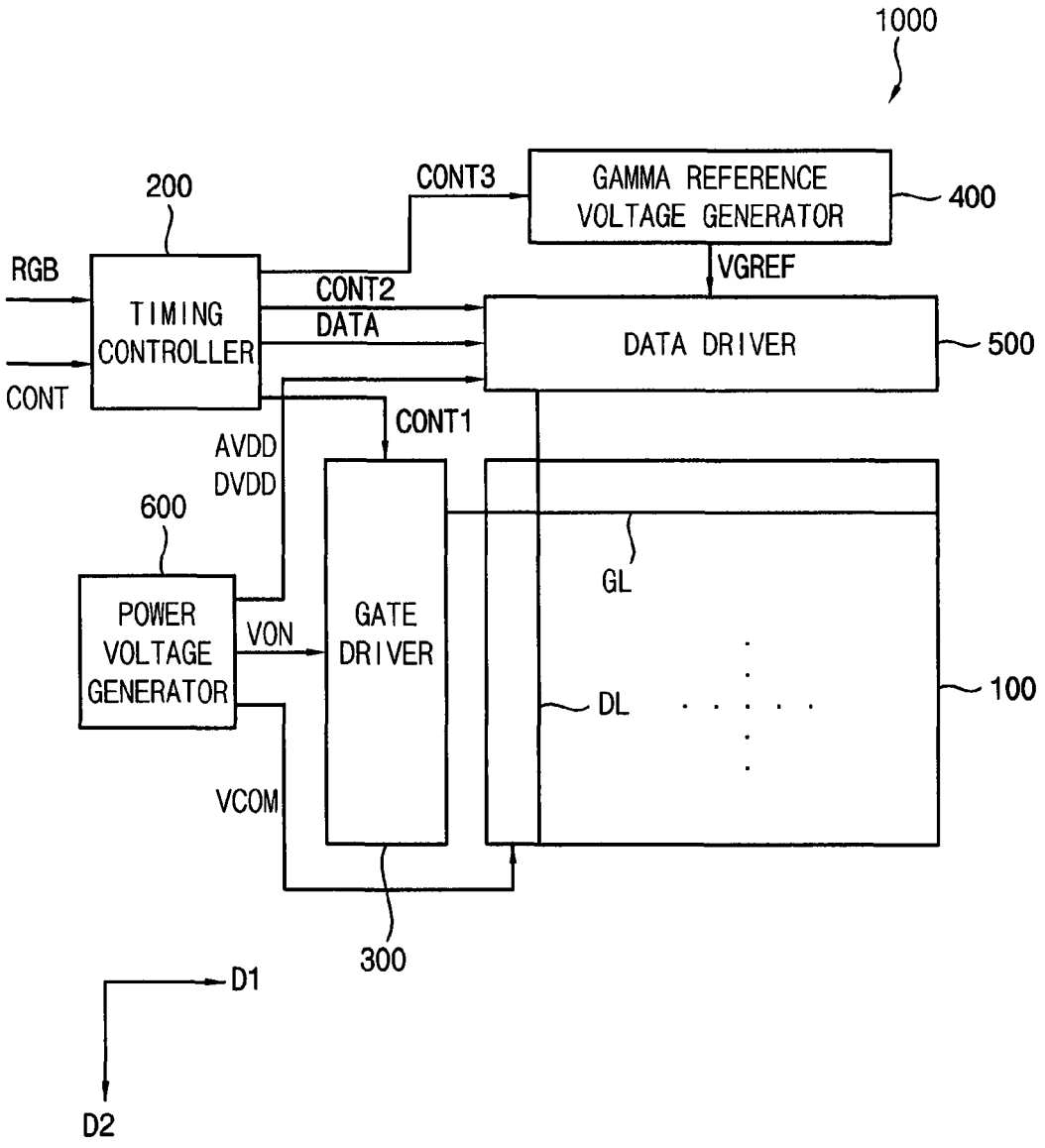
FIG. 1 is a block diagram illustrating an exemplary embodiment of a display apparatus according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in detail with reference to the accompanying drawings.

FIG. 1 is a block diagram illustrating an exemplary embodiment of a display apparatus 1000 according to the invention.

Referring to FIG. 1, an exemplary embodiment of the display apparatus 1000 includes a display panel 100 and a display panel driver. In such an embodiment, the display panel driver includes a timing controller 200, a gate driver 300, a gamma reference voltage generator 400 and a data driver 500.

The display panel 100 may have a display region on which an image is displayed and a peripheral region adjacent to the display region.

The display panel 100 includes a plurality of gate lines GL, a plurality of data lines DL and a plurality of subpixels connected to the gate lines GL and the data lines DL. The gate lines GL extend substantially in a first direction D1 and the data lines DL extend substantially in a second direction D2 crossing the first direction D1.

In such an embodiment, each subpixel includes a switching element (not shown), a liquid crystal capacitor (not shown) and a storage capacitor (not shown). The liquid crystal capacitor and the storage capacitor are electrically connected to the switching element. The subpixels may be disposed substantially in a matrix form. Some of the subpixels may define a pixel or a unit pixel. In one exemplary embodiment, for example, a red subpixel, a green subpixel and a blue subpixel of the subpixels may define a unit pixel.

A pixel structure of the display panel 100 will be described later in greater detail referring to FIGS. 2, 10A and 10B.

In such an embodiment, the timing controller 200 receives input image data RGB and an input control signal CONT from an external apparatus (not shown). The input image data may include red image data R, green image data G and blue image data B. The input control signal CONT may include a master clock signal and a data enable signal. The input control signal CONT may include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The timing controller 200 may determine an inversion driving method of the display panel 100 based on a waveform of a common voltage of the display panel 100.

A structure of the timing controller 200 will be described later in greater detail referring to FIG. 8.

The gate driver 300 generates gate signals driving the gate lines GL in response to the first control signal CONT1 received from the timing controller 200. The gate driver 300 sequentially outputs the gate signals to the gate lines GL.

In one exemplary embodiment, for example, the gate driver 300 may be directly mounted on the display panel 100, or may be connected to the display panel 100 as a tape carrier package ("TCP") type. Alternatively, the gate driver 300 may be integrated on the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 sequentially outputs the data voltages to the data lines DL.

In one exemplary embodiment, for example, the data driver 500 may be directly mounted on the display panel 100, or be connected to the display panel 100 in a TCP type. Alternatively, the data driver 500 may be integrated on the peripheral region of the display panel 100.

In an exemplary embodiment, the power voltage generator 600 generates power voltages used to drive the display apparatus 1000. In one exemplary embodiment, for example, the power voltage generator 600 generates the common voltage VCOM and outputs the common voltage VCOM to the display panel 100. In one exemplary embodiment, for example, the power voltage generator 600 generates a gate on voltage VON which defines a high level of the gate signal of the gate driver 300 and outputs the gate on voltage VON to the gate driver 300. In one exemplary embodiment, for example, the power voltage generator 600 generates a digital level power voltage DVDD and an analog level power voltage AVDD and outputs the digital level power voltage DVDD and the analog level power voltage AVDD to the data driver 500.

Figures 2, 3A:
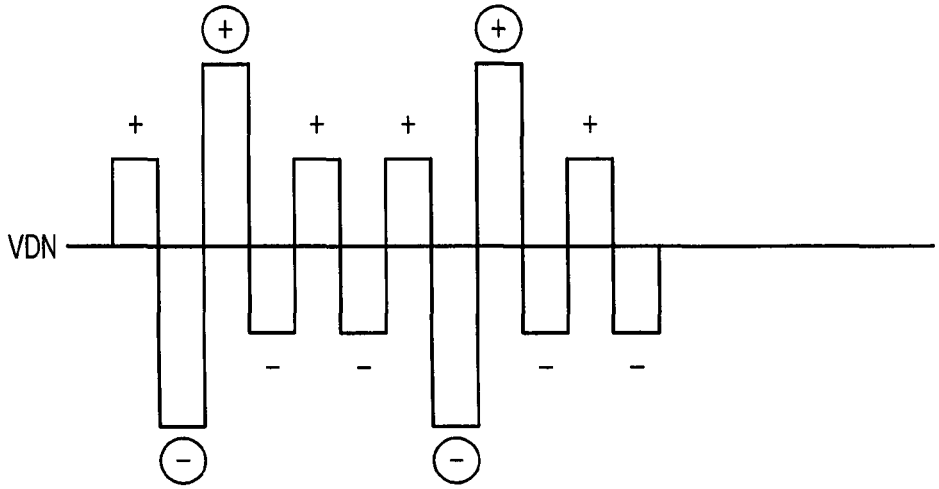
FIG. 2 is a conceptual diagram illustrating an image displayed on an exemplary embodiment of a display panel of FIG. 1 and polarities of pixel voltages thereof.
FIG. 3A is a conceptual diagram illustrating intensities and polarities of data voltages applied to an N-th subpixel row of FIG. 2.
Figure 3B:
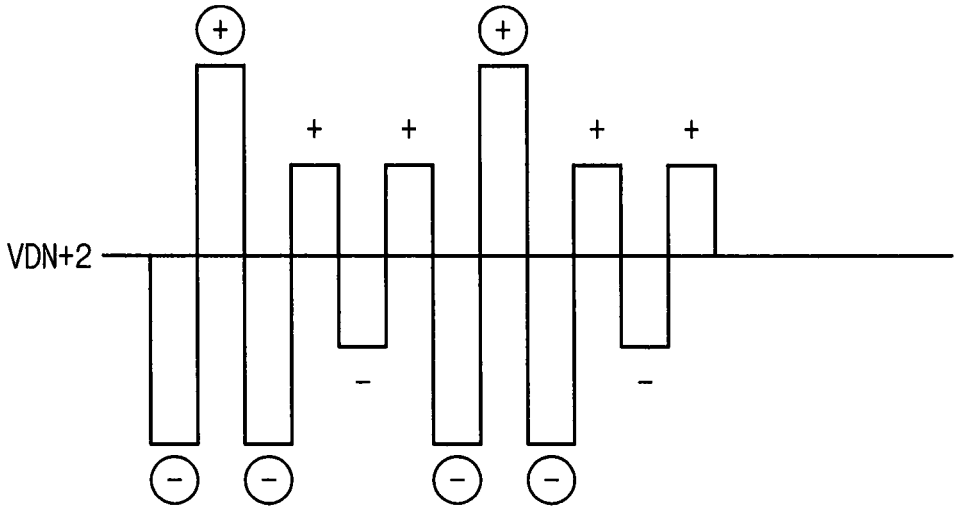
FIG. 3B is a conceptual diagram illustrating intensities and polarities of data voltages applied to an (N+2)-th subpixel row of FIG. 2.
Figure 4:
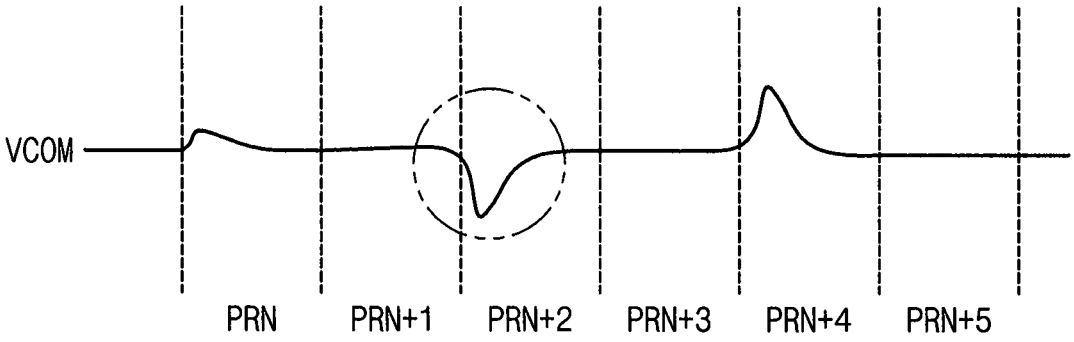
FIG. 4 is a waveform diagram illustrating a level of a common voltage when the display panel of FIG. 1 displays the image of FIG. 2.

FIG. 2 is a conceptual diagram illustrating an image displayed on an exemplary embodiment of the display panel 100 of FIG. 1 and polarities of pixel voltages thereof. FIG. 3A is a conceptual diagram illustrating intensities and polarities of data voltages applied to an N-th subpixel row of FIG. 2. FIG. 3B is a conceptual diagram illustrating intensities and polarities of data voltages applied to an (N+2)-th subpixel row of FIG. 2. FIG. 4 is a waveform diagram illustrating a level of the common voltage VCOM when the display panel 100 of FIG. 1 displays the image of FIG. 2.

In an exemplary embodiment, as shown in FIG. 2, four upper subpixel rows of the display panel 100 may display cyan checkerboard patterns. Subpixel rows except for the four upper subpixel rows may display vertical alternate patterns of white and black.

FIG. 3A represents a data voltage VDN applied to the N-th subpixel row PRN among subpixel rows displaying the cyan checkerboard patterns. The data voltage VDN applied to the N-th subpixel row PRN sequentially represents a low grayscale of a positive polarity, a high grayscale of a negative polarity, a high grayscale of the positive polarity, a low grayscale of the negative polarity, a low grayscale of the positive polarity and a low grayscale of the negative polarity from a first subpixel.

As shown in FIG. 3A, the number of subpixels representing the high grayscale of the positive polarity is two and the number of subpixels representing the high grayscale of the negative polarity is two, among the subpixels in the N-th subpixel row PRN. Thus, when the above patterns are repetitively displayed by the N-th subpixel row PRN, the data voltage VDN applied to the N-th subpixel row PRN has a balanced (or compensated) polarity.

FIG. 3B represents a data voltage VDN+2 applied to the (N+2)-th subpixel row PRN+2 among subpixel rows displaying the vertical alternate patterns of white and black. The data voltage VDN+2 applied to the (N+2)-th subpixel row PRN+2 sequentially represents a high grayscale of the negative polarity, a high grayscale of the positive polarity, a high grayscale of the negative polarity, a low grayscale of the positive polarity, a low grayscale of the negative polarity and a low grayscale of the positive polarity from a first subpixel.

As shown in FIG. 3B, the number of subpixels representing the high grayscale of the positive polarity is two and the number of subpixels representing the high grayscale of the negative polarity is four, among the subpixels in the (N+2)-th subpixel row PRN+2. Thus, when the above patterns are repetitive in the (N+2)-th subpixel row PRN+2, the polarity of the data voltage VDN+2 applied to the (N+2)-th subpixel row PRN+2 may be oriented toward the negative polarity.

Although not shown in figures, when the vertical alternate patterns of white and black are repetitive in the (N+4)-th subpixel row PRN+4, the polarity of the data voltage VDN+4 applied to the (N+4)-th subpixel row PRN+4 may be oriented toward the positive polarity.

FIG. 4 illustrates a level of the common voltage VCOM when the N-th subpixel row of the display panel 100 to an (N+5)-th subpixel row PRN+5 of the display panel 100 are sequentially driven.

When the data voltage VDN is applied to the N-th subpixel row PRN, the polarity of the data voltage VDN is balanced such that the ripple of the common voltage VCOM is effectively prevented from being generated.

When the data voltage VDN+2 is applied to the (N+2)-th subpixel row PRN+2, the polarity of the data voltage VDN+2 is oriented to the negative polarity such that the large ripple of the common voltage VCOM may be generated due to the coupling between the common voltage VCOM and the data voltage VDN+2.

In such an embodiment of the display panel 100, when the level of the common voltage VCOM is distorted by the ripple of the common voltage VCOM, the subpixels in the subpixel row may not display desired luminance.

In one exemplary embodiment, for example, when majority of the (N+2)-th subpixel row PRN+2 displays the vertical alternate patterns of white and black as shown in FIG. 2 and a small portion of the (N+2)-th subpixel row PRN+2 displays a cyan color, the cyan color displayed in the (N+2)-th subpixel row PRN+2 may be different from the cyan color displayed in the N-th subpixel row PRN. In one exemplary embodiment, for example, the luminance of the cyan color displayed in the (N+2)-th subpixel row PRN+2 may be less than the luminance of the cyan color displayed in the N-th subpixel row PRN.

As described above, the display panel 100 may not display the desired luminance due to the distortion of the common voltage VCOM. Accordingly, due to the luminance difference between a portion having a small distortion of the common voltage VCOM and a large distortion of the common voltage VCOM, the display defect may occur on the display panel 100.

Figure 5:
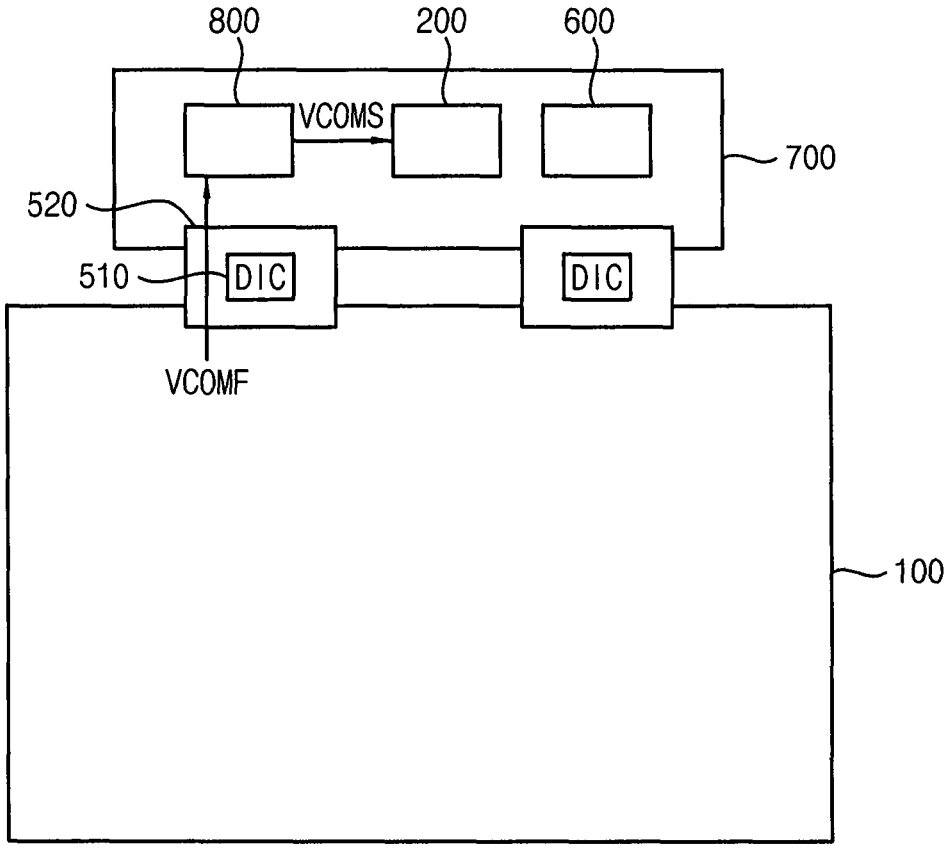
FIG. 5 is a block diagram illustrating an exemplary embodiment of the display panel and a display panel driver of FIG. 1.
Figure 6:
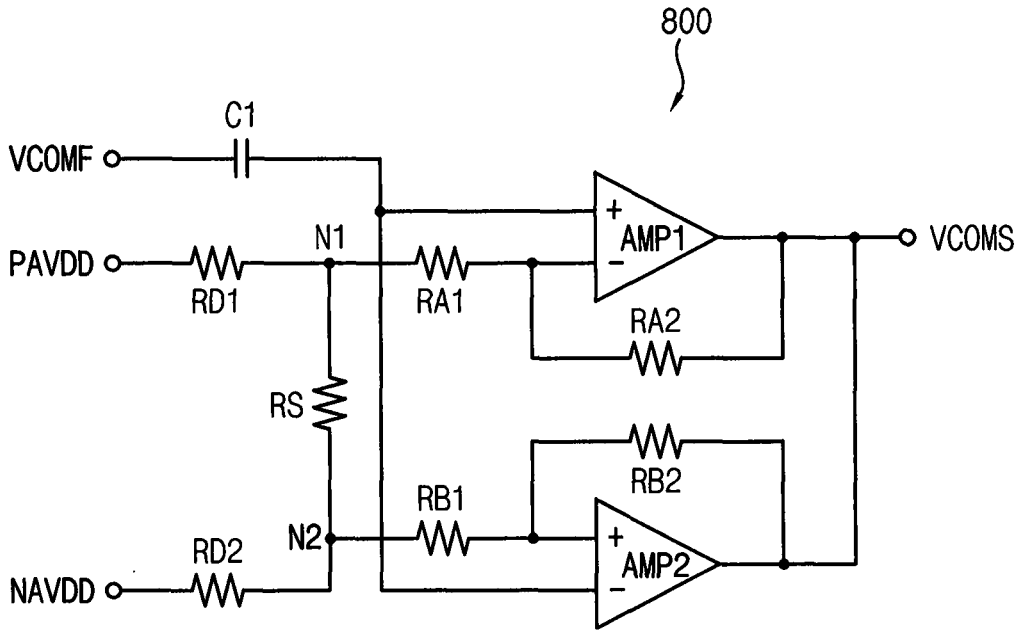
FIG. 6 is a circuit diagram illustrating an exemplary embodiment of a common voltage converting part of FIG. 5.
Figure 7:
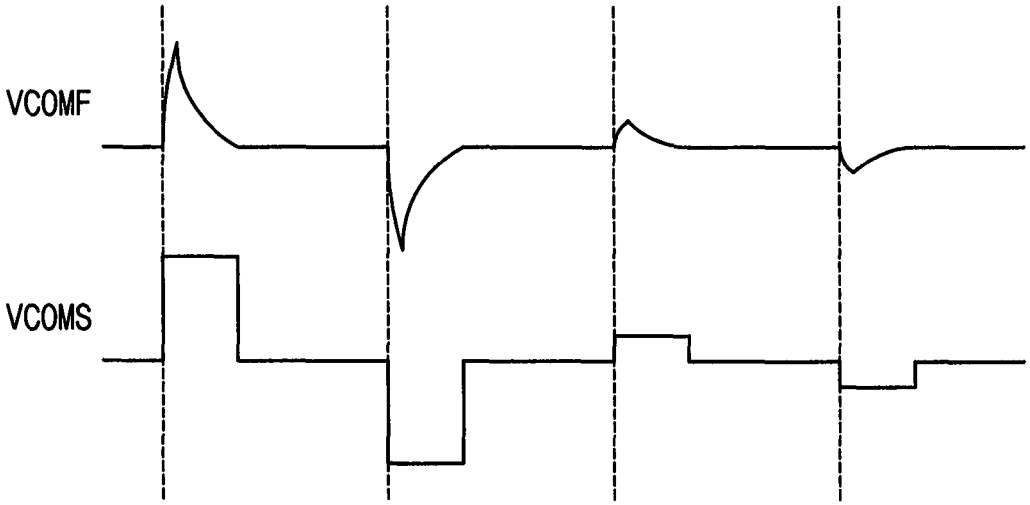
FIG. 7 is a waveform diagram illustrating an input voltage and an output voltage of the common voltage converting part of FIG. 5.

FIG. 5 is a block diagram illustrating an exemplary embodiment of the display panel 100 and a display panel driver of FIG. 1. FIG. 6 is a circuit diagram illustrating an exemplary embodiment of a common voltage converting part 800 of FIG. 5. FIG. 7 is a waveform diagram illustrating an input voltage and an output voltage of the common voltage converting part 800 of FIG. 5.

Referring to FIGS. 1 and 5 to 7, the display apparatus 1000 includes the display panel 100 and the display panel driver.

The display panel driver includes the timing controller 200, the gate driver 300, the gamma reference voltage generator 400, the data driver 500 and the power voltage generator 600.

For convenience of illustration, the gate driver 300 and the gamma reference voltage generator 400 are not shown in FIG. 5.

In an exemplary embodiment, the display panel driver further includes the common voltage converting part 800. The common voltage converting part 800 receives the fed back common voltage VCOMF from the display panel 100, converts the fed back common voltage VCOMF into a converted common voltage VCOMS in the form of a square wave signal and provides the converted common voltage VCOMS to the timing controller 200.

The display panel driver may further include a printed circuit board 700, on which the timing controller 200, the power voltage generator 600 and the common voltage converting part 800 are disposed.

The data driver 500 includes a data driving chip ("DIC") 510 that outputs the data voltage to the display panel 100 and a flexible printed circuit board 520 that connects the printed circuit board 700 to the display panel 100. The DIC 510 may be disposed on the flexible printed circuit board 520.

In an exemplary embodiment, as shown in FIG. 6, the common voltage converting part 800 may include a first amplifier AMP1 and a second amplifier AMP2. The first amplifier AMP1 receives positive ripple components of the fed back common voltage VCOMF and generates positive square waves based on the positive ripple components of the fed back common voltage VCOMF. The second amplifier AMP2 receives negative ripple components of the fed back common voltage VCOMF and generates negative square waves based on the negative ripple components of the fed back common voltage VCOMF.

In such an embodiment, the common voltage converting part 800 may further include a first capacitor C1, a first damping resistor RD1, a second damping resistor RD2 and a short preventing resistor RS. The first capacitor C1 includes a first end, to which the fed back common voltage VCOMF is applied, and a second end connected to a first input terminal (e.g., a positive input terminal) of the first amplifier AMP1 and a second input terminal (e.g., a negative input terminal) of the second amplifier AMP2. The first damping resistor RD1 includes a first end, to which a positive power voltage PAVDD is applied, and a second end connected to a first node N1. The second damping resistor RD2 includes a first end, to which a negative power voltage NAVDD is applied, and a second end connected to a second node N2. The short preventing resistor RS is connected between the first node N1 and the second node N2 to effectively prevent short between the positive power voltage PAVDD and the negative power voltage NAVDD.

The common voltage converting part 800 may further include a first amplifying resistor RA1 and a second amplifying resistor RA2. The first amplifying resistor RA1 includes a first end connected to the first node N1 and a second end connected to a second input terminal (e.g., a negative input terminal) of the first amplifier AMP1. The second amplifying resistor RA2 includes a first end connected to the second input terminal of the first amplifier AMP1 and a second end connected to an output terminal of the first amplifier AMP1.

By adjusting resistance of the first amplifying resistor RA1 and resistance of the second amplifying resistor RA2, a gain of the first amplifier AMP1 may be adjusted. By adjusting the gain of the first amplifier AMP1, an amplitude of the positive square wave of the converted common voltage VCOMS may be adjusted. The amplitude of the positive square wave of the converted common voltage VCOMS may be substantially proportional to the ripple of the fed back common voltage VCOMF.

The common voltage converting part 800 may further include a third amplifying resistor RB1 and a fourth amplifying resistor RB2. The third amplifying resistor RB1 includes a first end connected to the second node N2 and a second end connected to a first input terminal (e.g., a positive input terminal) of the second amplifier AMP2. The fourth amplifying resistor RB2 includes a first end connected to the first input terminal of the second amplifier AMP2 and a second end connected to an output terminal of the second amplifier AMP2.

By adjusting resistance of the third amplifying resistor RB1 and resistance of the fourth amplifying resistor RB2, a gain of the second amplifier AMP2 may be adjusted. By adjusting the gain of the second amplifier AMP2, an amplitude of the negative square wave of the converted common voltage VCOMS may be adjusted. The amplitude of the negative square wave of the converted common voltage VCOMS may be substantially proportional to the ripple of the fed back common voltage VCOMF.

In an exemplary embodiment, the timing controller 200 and the power voltage generator 600 may be formed as a single chip, e.g., an integrated circuit ("IC") chip, and the common voltage converting part 800 may be disposed on the printed circuit board 700 and be independently provided or formed from the timing controller 200 and the power voltage generator 600.

Alternatively, the power voltage generator 600 and the common voltage converting part 800 may be formed as a single chip.

Alternatively, the timing controller, the power voltage generator 600 and the common voltage converting part 800 may be formed as a single chip.

Figure 8:
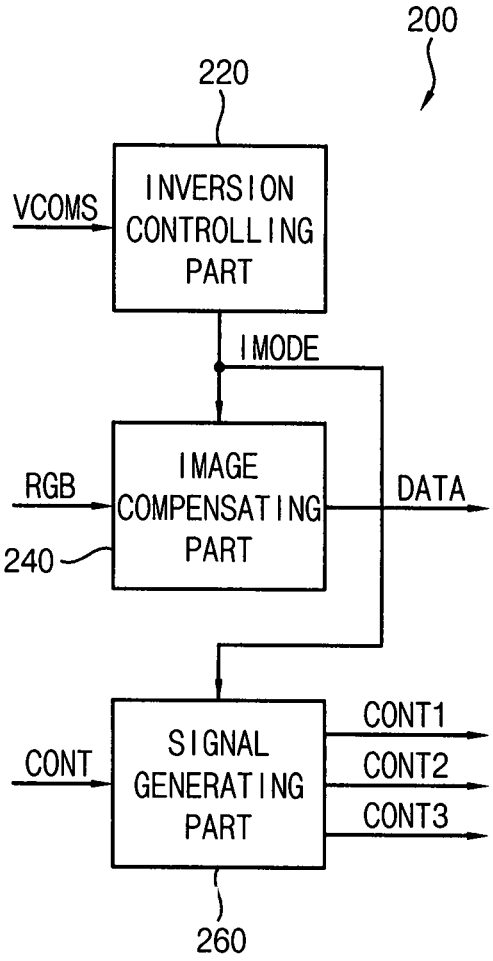
FIG. 8 is a block diagram illustrating an exemplary embodiment of a timing controller of FIG. 1.

FIG. 8 is a block diagram illustrating an exemplary embodiment of the timing controller 200 of FIG. 1.

Referring to FIGS. 1 and 5 to 8, an exemplary embodiment of the timing controller 200 includes an inversion controlling part 220, an image compensating part 240 and a signal generating part 260.

In such an embodiment, the inversion controlling part 220 may determine an inversion driving method IMODE of the display panel 100 based on the converted common voltage VCOMS which has a square wave type. Herein, the inversion driving method IMODE may be one of a plurality of predetermined inversion driving methods, e.g., a first inversion driving method and a second inversion driving method, or a main inversion driving method and a sub inversion driving method. In one exemplary embodiment, for example, the predetermined inversion driving methods may include a dot inversion driving method and a column inversion driving method, but not being limited thereto. Such predetermined inversion driving method may be determined based on a structure or specification of the display panel 100.

The inversion controlling part 220 may count the number of square waves that are equal to or greater than a distortion threshold among the square waves of the converted common voltage VCOMS. The distortion threshold is determined based on whether the square wave of the converted common voltage VCOMS substantially changes the luminance of the subpixel.

When the amplitude of the square wave of the converted common voltage VCOMS is equal to or greater than the distortion threshold, the subpixels in the subpixel row may not display the desired luminance. When the amplitude of the square wave of the converted common voltage VCOMS is less than the distortion threshold, the subpixels in the subpixel row may display the desired luminance.

In one exemplary embodiment, for example, a first positive square wave in FIG. 7 may be counted as the square wave equal to or greater than the distortion threshold. In one exemplary embodiment, for example, a first negative square wave in FIG. 7 may be counted as the square wave equal to or greater than the distortion threshold. In one exemplary embodiment, for example, a second positive square wave in FIG. 7 may not be counted as the square wave equal to or greater than the distortion threshold. In one exemplary embodiment, for example, a second negative square wave in FIG. 7 may not be counted as the square wave equal to or greater than the distortion threshold.

When the number of the square waves equal to or greater than the distortion threshold in a previous frame is equal to or greater than an inversion changing threshold, which may be defined as a value corresponding to a natural number, the inversion driving method of the display panel 100 in a present frame may be changed. When the number of the square waves equal to or greater than the distortion threshold in a previous frame is less than the inversion changing threshold, the inversion driving method of the display panel 100 in the present frame may be maintained.

The inversion changing threshold is determined based on whether the square waves equal to or greater than the distortion threshold generates the display defect due to the luminance difference.

When the number of the square waves equal to or greater than the distortion threshold is equal to or greater than the inversion changing threshold, the display defect may be generated in the inversion driving method. When the number of the square waves equal to or greater than the distortion threshold is less than the inversion changing threshold, the display defect may not be generated in the inversion driving method.

In an exemplary embodiment, as shown in FIG. 8, the inversion controlling part 220 determines the inversion driving method IMODE (e.g., select one of a plurality of predetermined inversion driving methods or changes among the predetermined inversion driving methods) based on the waveform of a fed back common voltage VCOMS. When it is determined that the display panel 100 has a display defect in the first inversion driving method based on the number of the square waves equal to or greater than the distortion threshold, the inversion controlling part 220 changes the first inversion driving method to the second inversion driving method. Thus, the display defect due to the first inversion driving method may disappear. Thus, the display quality of the display panel 100 may be improved.

Although the inversion controlling part 220 counts the number of the square waves equal to or greater than the distortion threshold in a frame to compare the number of the square waves to the inversion changing threshold in an exemplary embodiment, the invention is not limited thereto. Alternatively, the inversion controlling part 220 may count the number of the square waves equal to or greater than the distortion threshold in a plurality of frames to compare the number of the square waves to an inversion changing threshold which is determined for the plurality of the frames.

The inversion controlling part 220 determines the inversion driving method IMODE and may output, e.g., inform, the inversion driving method IMODE to the image compensating part 240 and the signal generating part 260.

The image compensating part 240 compensates the input image data RGB to generate a data signal DATA. The image compensating part 240 may rearrange the data signal DATA based on the inversion driving method IMODE, and may output the rearranged data signal DATA to the data driver 500.

The image compensating part 240 may include an adaptive color correcting part (not shown) and a dynamic capacitance compensating part (not shown).

The adaptive color correcting part receives the input image data RGB and operates an adaptive color correction ("ACC"). The adaptive color correcting part may compensate the input image data RGB using a gamma curve.

The dynamic capacitance compensating part operates a dynamic capacitance compensation ("DCC"), which compensates the grayscale data of present frame data using previous frame data and the present frame data.

The signal generating part 260 generates the first control signal CONT1 based on the input control signal CONT. The signal generating part 260 outputs the first control signal CONT1 to the gate driver 300. The signal generating part 260 generates the second control signal CONT2 based on the input control signal CONT. The signal generating part 260 outputs the second control signal CONT2 to the data driver 300. The signal generating part 260 generates the third control signal CONT3 based on the input control signal CONT. The signal generating part 260 outputs the third control signal CONT3 to the gamma reference voltage generator 400.

The signal generating part 260 may generate the second control signal CONT2 for controlling the data driver 500 based on the inversion driving method IMODE.

Figure 9:
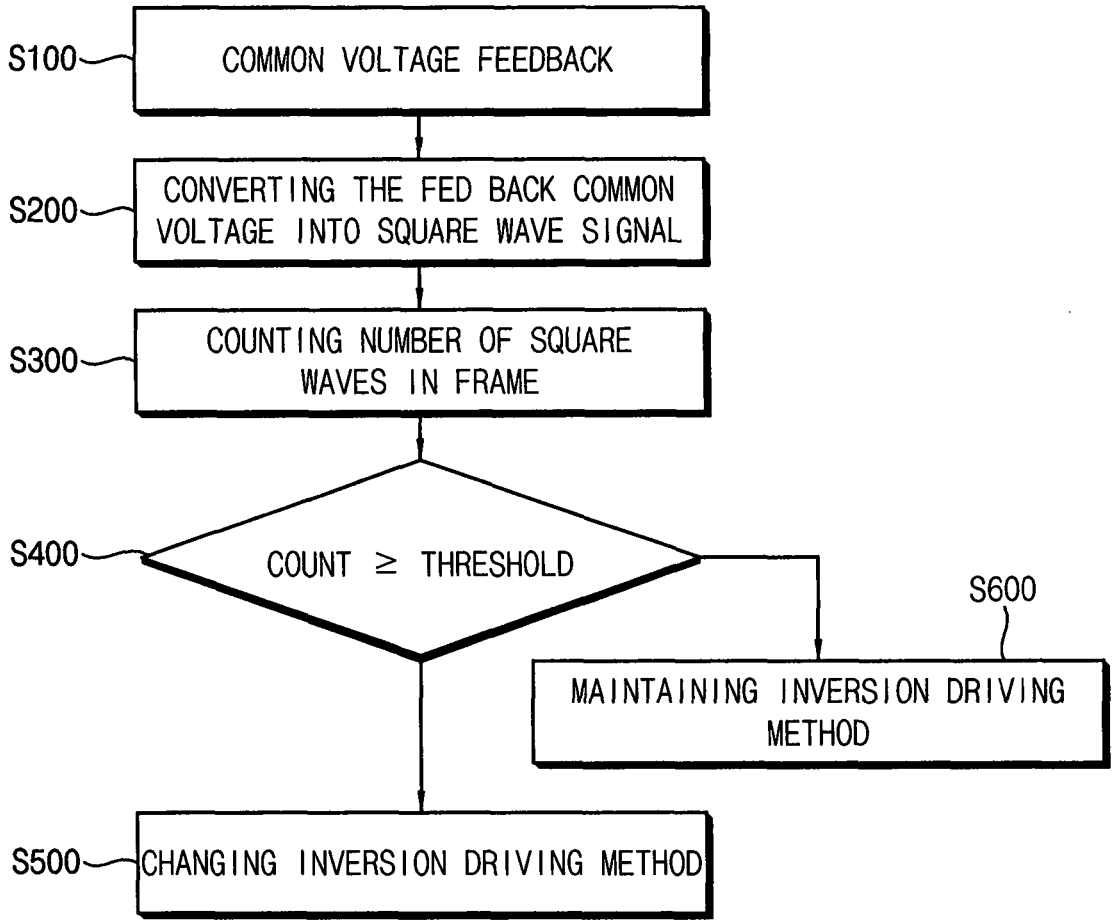
FIG. 9 is a flowchart illustrating an exemplary embodiment of a method of driving the display apparatus of FIG. 1.

FIG. 9 is a flowchart illustrating an exemplary embodiment of a method of driving the display apparatus 1000 of FIG. 1.

Referring to FIGS. 1 and 5 to 9, an exemplary embodiment of a method of driving the display apparatus 1000 includes receiving a fed back common voltage from the display panel (S100). In an exemplary embodiment of the display apparatus 1000, the common voltage converting part 800 receives the fed back common voltage VCOMF from the display panel 100.

Such an embodiment of the method of driving the display apparatus 100 further includes converting the fed back common voltage into a square wave signal (S200). In an exemplary embodiment of the display apparatus 1000, the common voltage converting part 800 converts the fed back common voltage VCOMF into the square wave signal to generate the converted common voltage VCOMS.

Such an embodiment of the method of driving the display apparatus 100 further includes determining an inversion driving method of a display panel based on a waveform of a common voltage of the display panel. In such an embodiment, the determining the inversion driving method of the display panel may include counting the number of square waves equal to or greater than a distortion threshold among the square waves of the common voltage (S300). In an exemplary embodiment of the display apparatus 1000, the inversion controlling part 220 of the timing controller 200 counts the number of the square waves equal to or greater than the distortion threshold.

The determining the inversion driving method of the display panel further includes changing the inversion driving method of the display panel in a frame when the number of the square waves equal to or greater than the distortion threshold in a previous frame is equal to or greater than an inversion changing threshold (S400). In an exemplary embodiment of the display apparatus 1000, the inversion controlling part 220 compares the number of the square waves equal to or greater than the distortion threshold to the inversion changing threshold THRESHOLD.

In such an embodiment, when the number of the square waves equal to or greater than the distortion threshold is equal to or greater than the inversion changing threshold THRESHOLD, the inversion driving method is changed, e.g., the inversion controlling part 220 changes the inversion driving method (S500).

In such an embodiment, when the number of the square waves equal to or greater than the distortion threshold is less than the inversion changing threshold THRESHOLD, the inversion driving method is maintained, e.g., the inversion controlling part 220 maintains the inversion driving method (S600).

In an exemplary embodiment, when the display panel 100 is driven in a first inversion driving method and the number of the square waves equal to or greater than the distortion threshold is equal to or greater than the inversion changing threshold THRESHOLD, the inversion controlling part 220 may change the inversion driving method of the display panel 100 from the first inversion driving method to a second inversion driving method.

Then, when the display panel 100 is driven in the second inversion driving method and the number of the square waves equal to or greater than the distortion threshold is less than the inversion changing threshold THRESHOLD, the inversion controlling part 220 may maintain the inversion driving method of the display panel 100 as the second inversion driving method.

Then, when the display panel 100 is driven in the second inversion driving method and the number of the square waves equal to or greater than the distortion threshold is equal to or greater than the inversion changing threshold THRESHOLD, the inversion controlling part 220 may change the inversion driving method of the display panel 100 from the second inversion driving method to the first inversion driving method.

In an exemplary embodiment, when the display panel 100 is driven in a main inversion driving method and the number of the square waves equal to or greater than the distortion threshold is equal to or greater than the inversion changing threshold THRESHOLD, the inversion controlling part 220 may change the inversion driving method of the display panel 100 from the main inversion driving method to a sub inversion driving method.

Then, although the display panel 100 is in the sub inversion driving method and the number of the square waves equal to or greater than the distortion threshold is less than the inversion changing threshold THRESHOLD, when the display image on the display panel 100 is changed, the inversion controlling part 220 may recover the inversion driving method of the display panel 100 to the main inversion driving method.

When the display panel 100 is driven in a main inversion driving method and the number of the square waves equal to or greater than the distortion threshold is equal to or greater than the inversion changing threshold THRESHOLD again, the inversion controlling part 220 may change the inversion driving method of the display panel 100 from the main inversion driving method to the sub inversion driving method.

Figure 10A:
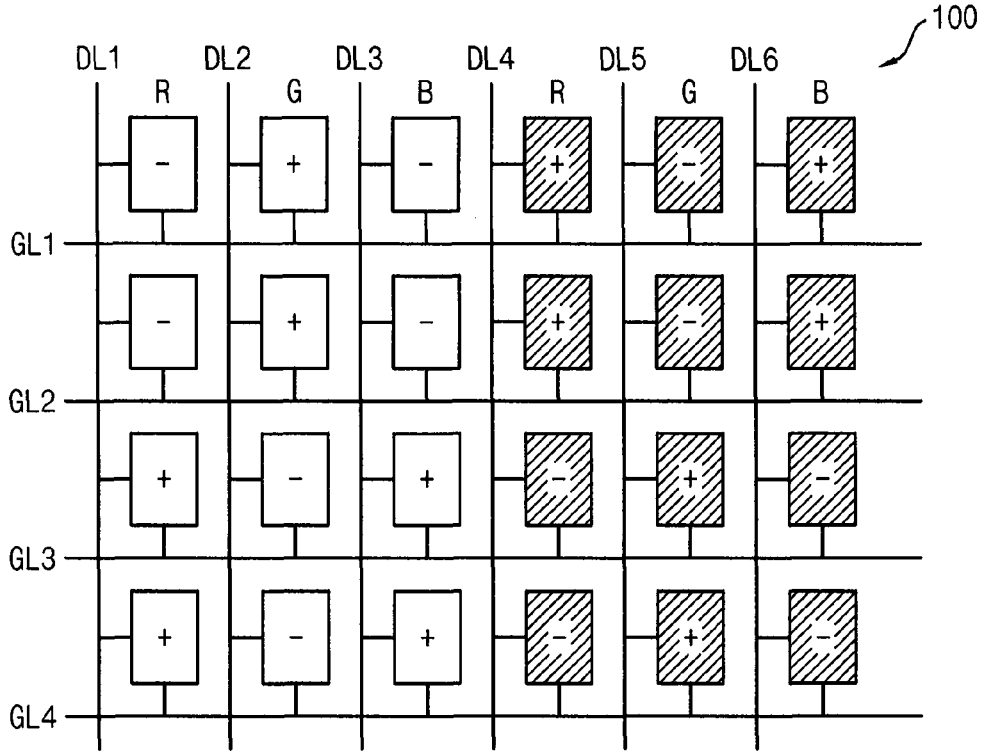
FIG. 10A is a conceptual diagram illustrating polarities of an exemplary embodiment of the display panel of FIG. 1, when driven based on a first inversion driving method.

FIG. 10A is a conceptual diagram illustrating polarities of the display panel 100 of FIG. 1 when driven based on the first inversion driving method. FIG. 10 B is a conceptual diagram illustrating polarities of the display panel 100 of FIG. 1 when driven based on the second inversion driving method.

Figure 10B:
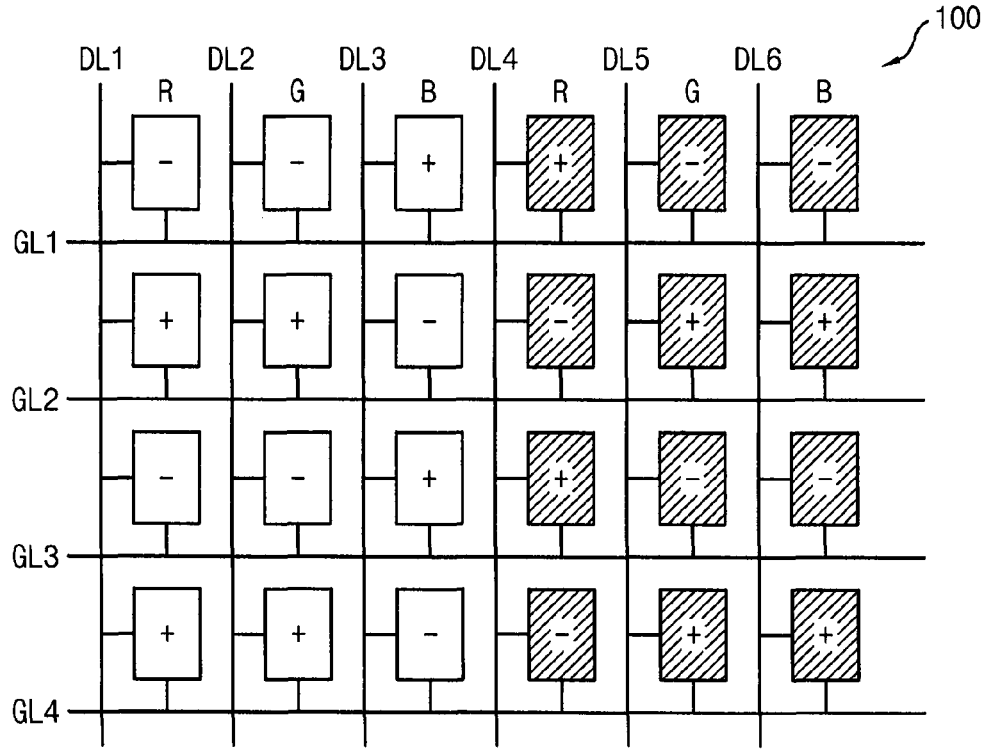
FIG. 10 B is a conceptual diagram illustrating polarities of an exemplary embodiment of the display panel of FIG. 1, when driven based on a second inversion driving method.

In FIGS. 10A and 10B, the subpixels in four rows and six columns are illustrated for convenience of illustration, but the invention is not limited thereto, that is, the display panel 100 may include further subpixels.

Referring to FIGS. 1 and 5 to 10B, an exemplary embodiment of the display panel 100 may have a non-alternating pixel structure. In an exemplary embodiment of the display panel 100 having the non-alternating pixel structure, subpixels disposed in a same pixel column are connected to same data line disposed on a left or right side thereof. In one exemplary embodiment, for example, subpixels in a first subpixel column are connected to a first data line DL1, subpixels in a second subpixel column are connected to a second data line DL2, subpixels in a third subpixel column are connected to a third data line DL3 and subpixels in a fourth subpixel column are connected to a fourth data line DL4.

The display panel 100 is driven in one of the first inversion driving method and the second inversion driving method based on the waveform of the fed back common voltage VCOMF.

When the display panel 100 is driven in the first inversion driving method, polarities of the subpixels are inverted in every dot along a row direction and polarities of the subpixels are inverted in every two dots along a column direction. In such an embodiment, the first inversion driving method may be a vertical 2 dot inversion.

When the display panel 100 is driven in the second inversion driving method, polarities of the subpixels are inverted in every two dots along the row direction and polarities of the subpixels are inverted in every dot along the column direction. In such an embodiment, the first inversion driving method may be a horizontal 2 dot inversion.

The display panel 100 in FIG. 10A may display vertical alternate patterns of white and black. When the display panel 100 is driven in the first inversion driving method, polarities of the subpixels having the high grayscale in the first and second subpixel rows are repetitively −, +, −/−, +, −. Thus, the polarities of the data voltages in the first and second subpixel rows are oriented to the negative polarity. When the display panel 100 is driven in the first inversion driving method, polarities of the subpixels having the high grayscale in the third and fourth subpixel rows are repetitively +, −, +/+, −, +. Thus, the polarities of the data voltages in the third and fourth subpixel rows are oriented to the positive polarity.

As described above, when the display panel 100 displays the vertical alternate patterns of white and black based on the first inversion driving method, the distortion of the common voltage VCOM may be generated such that the display defect may be generated.

In such an embodiment, the inversion controlling part 220 may change the inversion driving method of the display panel 100 from the first inversion driving method shown in FIG. 10A to the second inversion driving method as shown in FIG. 10B.

The display panel 100 in FIG. 10B may display the vertical alternate patterns of white and black like in FIG. 10A. When the display panel 100 is driven in the second inversion driving method, polarities of the subpixels having the high grayscale in the first and third subpixel rows are repetitively −, −, +/+, +, −. Thus, the polarities of the data voltages in the first and third subpixel rows are balanced. When the display panel 100 is driven in the second inversion driving method, polarities of the subpixels having the high grayscale in the second and fourth subpixel rows are repetitively +, +, −/−, −, +. Thus, the polarities of the data voltages in the second and fourth subpixel rows are balanced.

As described above, when the inversion driving method of display panel 100 is changed from the first inversion driving method to the second inversion driving method, the ripple of the common voltage VCOM is effectively prevented such that the display defect may be effectively prevented.

According to exemplary embodiments of the invention, the inversion driving method IMODE of the display panel 100 is determined based on the waveform of the fed back common voltage VCOMF, that is, the common voltage VCOM in the display panel 100. When the ripple of the common voltage VCOM is generated or the level of the common voltage is distorted, the inversion driving method IMODE of the display panel 100 is changed such that the display defect due to the distortion of the common voltage VCOM may be effectively prevented. Thus, the display quality of the display panel 100 may be substantially improved.

Figure 11A:
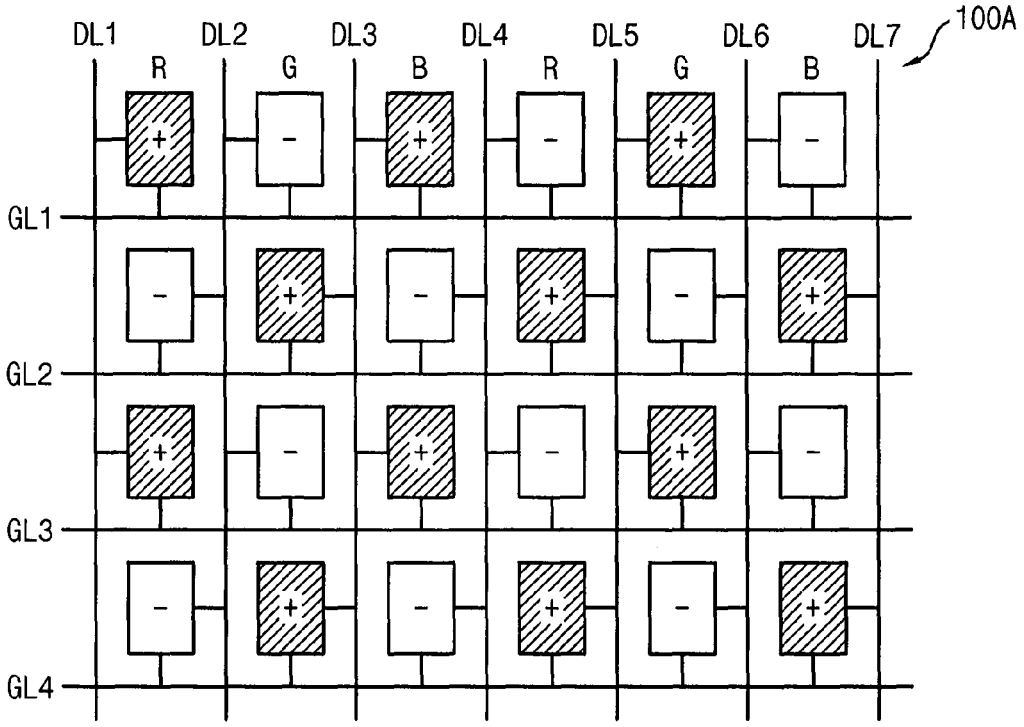
FIG. 11A is a conceptual diagram illustrating polarities of an exemplary embodiment of a display panel according to the invention, when driven based on a first inversion driving method.
Figure 11B:
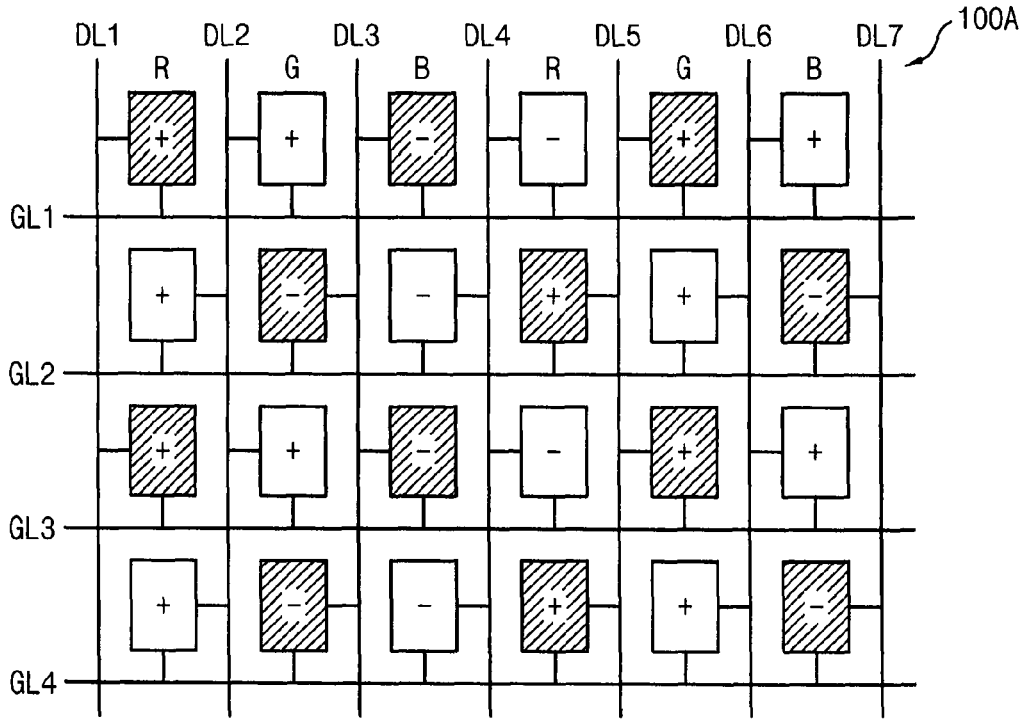
FIG. 11B is a conceptual diagram illustrating polarities of the display panel of FIG. 11A, when driven based on a second inversion driving method.

FIG. 11A is a conceptual diagram illustrating polarities of an exemplary embodiment of a display panel according to the invention when driven based on a first inversion driving method. FIG. 11B is a conceptual diagram illustrating polarities of the display panel of FIG. 11A when driven based on a second inversion driving method.

In FIGS. 10A and 10B, the subpixels in four rows and six columns are shown for convenience of illustration, but the invention is not limited thereto, that is, the display panel 100 may include further subpixels.

Referring to FIGS. 1, 5 to 9, 11A and 11B, an exemplary embodiment of the display panel 100A has an alternating pixel structure. In an exemplary embodiment of the display panel 100A having the alternating pixel structure, subpixels disposed in a same pixel column are alternately connected to a data line on a left side and a data line on a right side thereof. In one exemplary embodiment, for example, subpixels in a first subpixel column are alternately connected to a first data line DL1 and a second data line DL2, subpixels in a second subpixel column are alternately connected to the second data line DL2 and a third data line DL3 and subpixels in a third subpixel column are alternately connected to the third data line DL3 and a fourth data line DL4.

The display panel 100A is driven in one of the first inversion driving method and the second inversion driving method based on the waveform of the fed back common voltage VCOM therefrom.

When the display panel 100A is driven in the first inversion driving method of the display panel 100A, data voltages having a first polarity are applied to the first data line DL1 and the third data line DL3 and data voltages having a second polarity opposite to the first polarity are applied to the second data line DL2 and the fourth data line DL4. The first inversion driving method is a column inversion in a viewpoint of the data driver 500 and a dot inversion in a viewpoint of the display panel 100A.

When the display panel 100A is driven in the second inversion driving method of the display panel 100A, data voltages having the first polarity are applied to the first data line DL1 and the second data line DL2 and data voltages having the second polarity are applied to the third data line DL3 and the fourth data line DL4. The second inversion driving method is a two column inversion in a viewpoint of the data driver 500.

In an exemplary embodiment, the display panel 100A in FIG. 11A may display checker board patterns in every subpixel. In such an embodiment, when the display panel 100A is driven in the first inversion driving method, polarities of the subpixels having the high grayscale are all negative (−). Thus, the polarities of the data voltages are oriented to the negative polarity.

In such an embodiment, as described above, when the display panel 100A displays the checker board patterns in every subpixel in the first inversion driving method, the distortion of the common voltage VCOM may be generated such that the display defect may occur.

In such an embodiment, the inversion controlling part 220 changes the inversion driving method of the display panel 100 from the first inversion driving method as shown in FIG. 11A to the second inversion driving method as shown in FIG. 11B.

In an exemplary embodiment, the display panel 100A in FIG. 11B may display the checker board patterns in every subpixel like in FIG. 11A. In such an embodiment, when the display panel 100A is driven in the second inversion driving method, polarities of the subpixels having the high grayscale in all subpixel rows are repetitively in a polarity sequence of "+, −, +, −." Thus, the polarities of the data voltages in all subpixel rows are balanced.

In an exemplary embodiment, as described above, when the inversion driving method of display panel 100A is changed from the first inversion driving method to the second inversion driving method, the ripple of the common voltage VCOM is effectively prevented so that the display defect may be effectively prevented.

According to exemplary embodiments, the inversion driving method IMODE of the display panel 100A is determined based on the waveform of the fed back common voltage VCOMF or the common voltage VCOM in the display panel 100A. When the ripple of the common voltage VCOM is generated or the level of the common voltage is distorted, the inversion driving method IMODE of the display panel 100A is changed to another predetermined inversion driving method such that the display defect due to the distortion of the common voltage VCOM may be effectively prevented. Thus, in such an embodiment, the display quality of the display panel 100A may be substantially improved.

According to exemplary embodiments of the invention as set forth herein, the inversion driving method is changed based on the waveform of the common voltage in the display panel so that the display quality of the display panel may be substantially improved.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A display apparatus comprising:

a display panel which displays an image;

a timing controller which changes between a first inversion driving method and a second inversion driving method different from the first inversion driving method of the display panel based on a received waveform of a fed back common voltage from the display panel; and a data driver which outputs a data voltage to the display panel based on the first or second inversion driving method.

2. The display apparatus of claim 1, further comprising:

a common voltage converting part which receives the fed back common voltage from the display panel and converts the fed back common voltage into a square wave signal to output a converted common voltage to the timing controller.

3. The display apparatus of claim 2, wherein the common voltage converting part comprises:

a first amplifier which receives a positive ripple component of the fed back common voltage and generates a positive square wave based on the positive ripple component of the fed back common voltage; and a second amplifier which receives a negative ripple component of the fed back common voltage and generates a negative square wave based on the negative ripple component of the fed back common voltage.

4. The display apparatus of claim 3, wherein the common voltage converting part further comprises:

a capacitor including a first end to which the fed back common voltage is applied and a second end connected to a first input terminal of the first amplifier and a second input terminal of the second amplifier;

a first damping resistor including a first end to which a positive power voltage is applied and a second end connected to a first node;

a second damping resistor including a first end to which a negative power voltage is applied and a second end connected to a second node; and a short preventing resistor connected between the first node and the second node.

5. The display apparatus of claim 4, wherein the common voltage converting part further comprises:

a first amplifying resistor including a first end connected to the first node and a second end connected to a second input terminal of the first amplifier;

a second amplifying resistor including a first end connected to the second input terminal of the first amplifier and a second end connected to an output terminal of the first amplifier;

a third amplifying resistor including a first end connected to the second node and a second end connected to a first input terminal of the second amplifier; and a fourth amplifying resistor including a first end connected to the first input terminal of the second amplifier and a second end connected to an output terminal of the second amplifier.

6. The display apparatus of claim 2, wherein the timing controller comprises:

an inversion controlling part which determines the inversion driving method based on the converted common voltage which is the square wave signal;

a signal generating part which outputs a data control signal to the data driver for controlling the data driver based on the inversion driving method; and an image compensating part which rearranges a data signal based on the inversion driving method and outputs the rearranged data signal to the data driver.

7. The display apparatus of claim 6, wherein the inversion controlling part which counts the number of square waves equal to or greater than a distortion threshold among square waves of the converted common voltage, and the inversion controlling part which changes the inversion driving method of the display panel in a present frame when the number of the square waves equal to or greater than the distortion threshold in a previous frame is equal to or greater than an inversion changing threshold.

8. The display apparatus of claim 1, wherein the display panel comprises:

a plurality of subpixels substantially in a matrix form; and a plurality of data lines connected to the subpixels, and the display panel has a non-alternating pixel structure, in which the subpixels in a first subpixel column are connected to a first data line of the data lines, and the subpixels in a second subpixel column are connected to a second data line of the data lines.

9. The display apparatus of claim 8, wherein the display panel is driven in one of the first inversion driving method and a second inversion driving method based on the waveform of the fed back common voltage, when the display panel is driven in the first inversion driving method, polarities of the subpixels are inverted in every dot along a row direction and polarities of the subpixels are inverted in every two dots along a column direction, and when the display panel is driven in the second inversion driving method, polarities of the subpixels are inverted in every two dots along the row direction and polarities of the subpixels are inverted in every dot along the column direction.

10. The display apparatus of claim 1, wherein the display panel comprises:

a plurality of subpixels substantially in a matrix form; and a plurality of data lines connected to the subpixels, and the display panel has an alternating pixel structure, in which the subpixels in a first subpixel column are alternately connected to a first data line and a second data line of the data lines, the subpixels in a second subpixel column are alternately connected to the second data line and a third data line of the data lines, and the subpixels in a third subpixel column are alternately connected to the third data line and a fourth data line of the data lines.

11. The display apparatus of claim 10, wherein the display panel is driven in one of the first inversion driving method and the second inversion driving method based on the waveform of the fed back common voltage, when the display panel is driven in the first inversion driving method, data voltages having a first polarity are applied to the first data line and the third data line and data voltages having a second polarity opposite to the first polarity are applied to the second data line and the fourth data line, and when the display panel is driven in the second inversion driving method, data voltages having the first polarity are applied to the first data line and the second data line and data voltages having the second polarity are applied to the third data line and the fourth data line.

12. A method of driving a display apparatus, the method comprising:

changing between a first inversion driving method and a second inversion driving method different from the first inversion driving method of a display panel of the display apparatus based on a received waveform of a fed back common voltage from the display panel; and outputting a data voltage to the display panel according to the first or second inversion driving method.

13. The method of claim 12, further comprising:

receiving the fed back common voltage from the display panel; and converting the fed back common voltage into a square wave signal to generate a converted common voltage.

14. The method of claim 13, wherein the converting the fed back common voltage into the square wave signal comprises using a common voltage converting part, wherein the common voltage converting part comprises:

a first amplifier which receives a positive ripple component of the fed back common voltage and generates a positive square wave based on the positive ripple component of the fed back common voltage; and a second amplifier which receives a negative ripple component of the fed back common voltage and generates a negative square wave based on the negative ripple component of the fed back common voltage.

15. The method of claim 14, wherein the common voltage converting part further comprises:

a capacitor including a first end to which the fed back common voltage is applied and a second end connected to a first input terminal of the first amplifier and a second input terminal of the second amplifier;

a first damping resistor including a first end to which a positive power voltage is applied and a second end connected to a first node;

a second damping resistor including a first end to which a negative power voltage is applied and a second end connected to a second node; and a short preventing resistor connected between the first node and the second node.

16. The method of claim 15, wherein the common voltage converting part further comprises:

a first amplifying resistor including a first end connected to the first node and a second end connected to a second input terminal of the first amplifier;

a second amplifying resistor including a first end connected to the second input terminal of the first amplifier and a second end connected to an output terminal of the first amplifier;

a third amplifying resistor including a first end connected to the second node and a second end connected to a first input terminal of the second amplifier; and a fourth amplifying resistor including a first end connected to the first input terminal of the second amplifier and a second end connected to an output terminal of the second amplifier.

17. The method of claim 13, wherein the determining the inversion driving method of the display panel comprises:

counting the number of square waves equal to or greater than a distortion threshold among square waves of the converted common voltage; and changing the inversion driving method of the display panel in a present frame when the number of the square waves equal to or greater than the distortion threshold in a previous frame is equal to or greater than an inversion changing threshold.

* * * * *